US010048024B1

(12) United States Patent
Sole et al.

(10) Patent No.: US 10,048,024 B1
(45) Date of Patent: Aug. 14, 2018

(54) TWO-PHASE FLUID FLOW DISTRIBUTOR AND METHOD FOR PARALLEL MICROCHANNEL EVAPORATORS AND CONDENSERS

(71) Applicants: Joshua D. Sole, Rockledge, FL (US); John G. Bustamante, Orlanod, FL (US); Fritz F. Laun, Merritt Island, FL (US); Robert P. Scaringe, Rockledge, FL (US)

(72) Inventors: Joshua D. Sole, Rockledge, FL (US); John G. Bustamante, Orlanod, FL (US); Fritz F. Laun, Merritt Island, FL (US); Robert P. Scaringe, Rockledge, FL (US)

( * ) Notice: Subject to any disclaimer, the term of this patent is extended or adjusted under 35 U.S.C. 154(b) by 0 days.

(21) Appl. No.: 15/497,665

(22) Filed: Apr. 26, 2017

(51) Int. Cl.

| | |
|---|---|
| ***F28F 7/00*** | (2006.01) |
| ***F28F 9/02*** | (2006.01) |
| ***F28D 1/04*** | (2006.01) |
| ***F28D 1/053*** | (2006.01) |
| *F28D 21/00* | (2006.01) |

(52) U.S. Cl.
CPC ..... *F28F 9/028* (2013.01); *F28D 1/0435* (2013.01); *F28D 1/05341* (2013.01); *F28F 9/0273* (2013.01); *F28D 2021/0071* (2013.01)

(58) Field of Classification Search
CPC . F28F 9/028; F28F 9/0273; F28F 9/20; F28D 1/0435; F28D 1/05341; F28D 2021/0071; F28D 15/043; B01D 61/368; F28C 1/14
USPC ..... 165/139
See application file for complete search history.

(56) References Cited

U.S. PATENT DOCUMENTS

| | | | | |
|---|---|---|---|---|
| 2,350,348 | A | 6/1944 | Gaugler | |
| 3,587,730 | A | 6/1971 | Milton | |
| 3,870,485 | A * | 3/1975 | Shiraishi | F28C 1/14 239/566 |
| 4,731,017 | A * | 3/1988 | Echigo | F28F 9/20 126/92 AC |
| 4,890,668 | A * | 1/1990 | Cima | F28D 15/043 165/104.25 |
| 5,967,228 | A | 10/1999 | Bergman et al. | |
| 8,662,148 | B2 | 3/2014 | Wand | |
| 9,409,129 | B2 * | 8/2016 | Duke | B01D 61/368 |
| 2008/0099191 | A1 | 5/2008 | Taras et al. | |
| 2008/0141708 | A1 | 6/2008 | Obosu et al. | |
| 2013/0312436 | A1 | 11/2013 | Chen et al. | |

* cited by examiner

*Primary Examiner* — Davis Hwu

(57) ABSTRACT

A two-phase fluid flow distribution system and method for a parallel flow evaporator or condenser are disclosed. Uniform distribution of the two-phase flow within a parallel microchannel heat transfer passages and increased system performance is achieved by integrating an orientation-insensitive, two-phase flow distribution device within the inlet. manifolds of the microchannel heat exchanger passages.

14 Claims, 8 Drawing Sheets

Fig. 2A
(Prior Art)
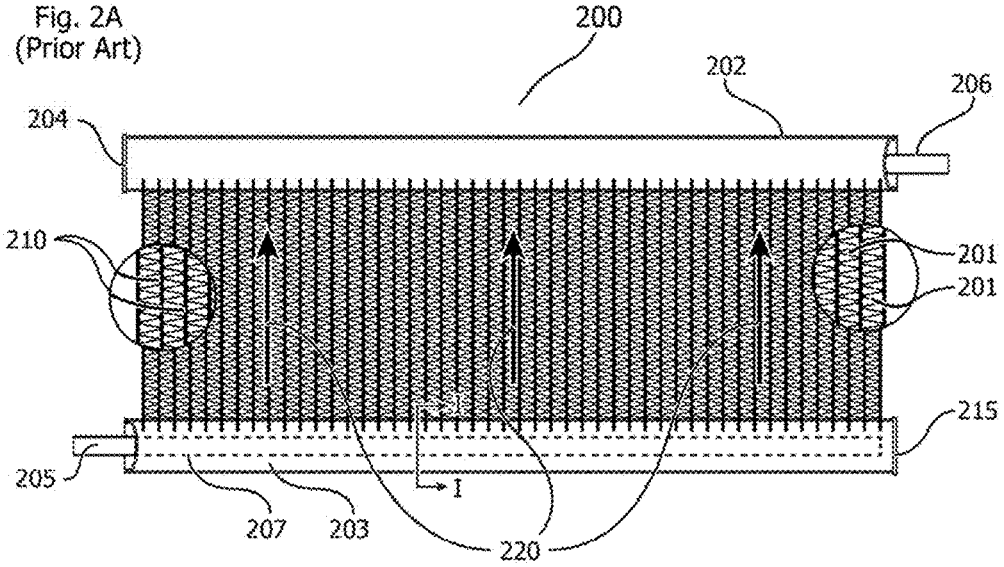
Fig. 2B (Sectional View)
(Prior Art)
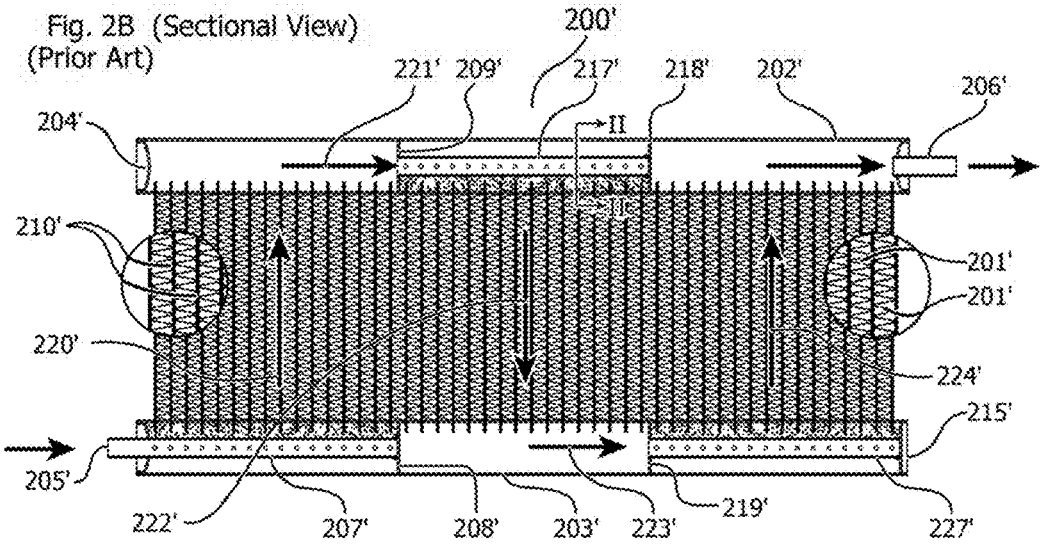

Fig. 4A (Prior Art)
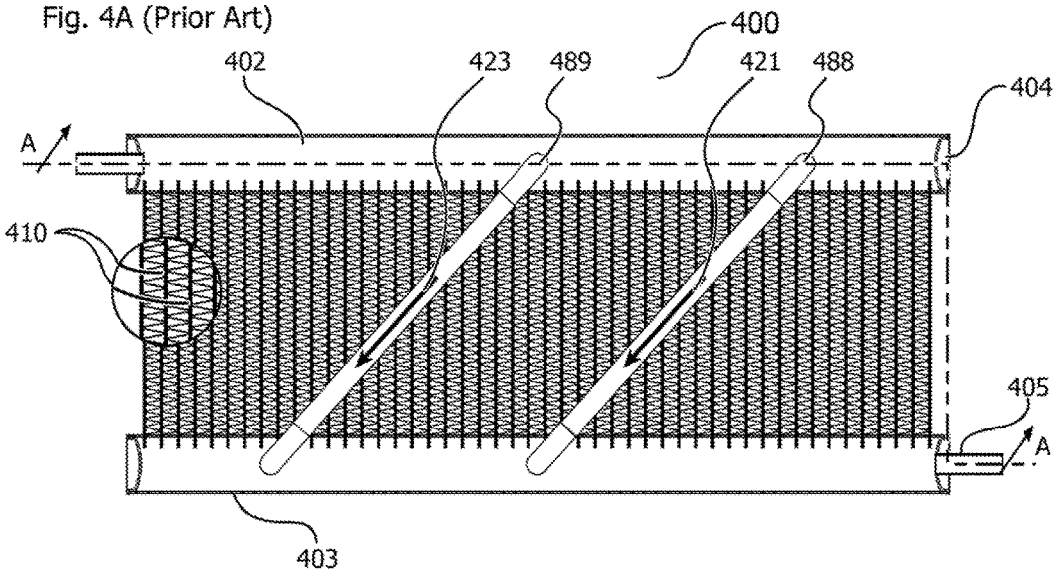
Fig. 4B Section A-A (Prior Art)
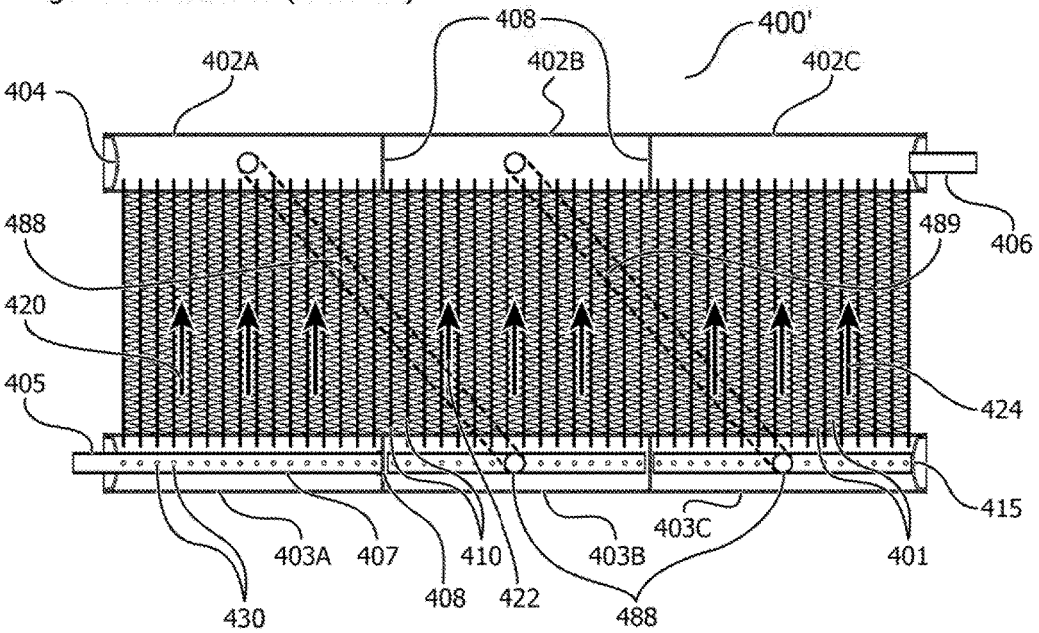

Fig. 6 (Sectional View)
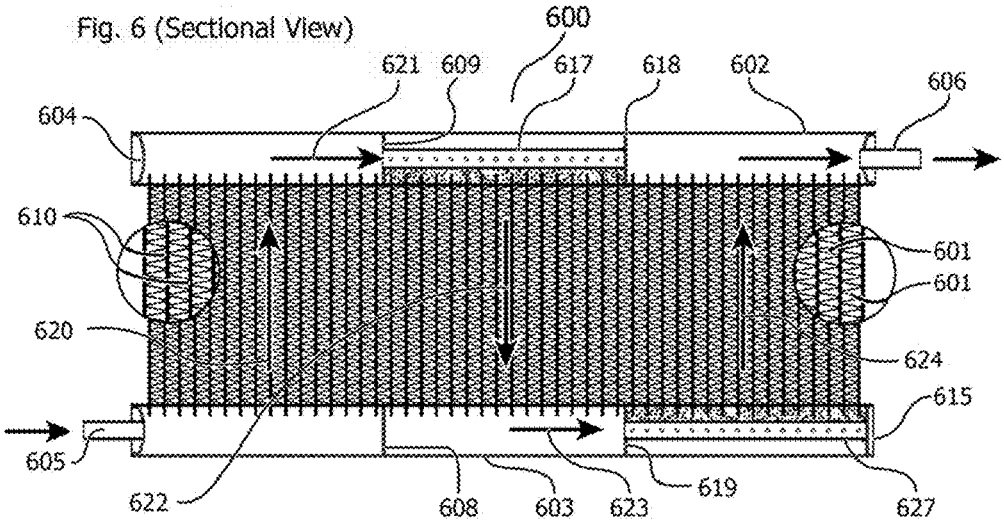

TWO-PHASE FLUID FLOW DISTRIBUTOR AND METHOD FOR PARALLEL MICROCHANNEL EVAPORATORS AND CONDENSERS

CROSS-REFERENCE TO RELATED APPLICATION

This application is related application Ser. No. 15/478,474, filed in the name of Brian P. Tucker et al. on Apr. 4, 2017 entitled "Advanced Cooling System Using Throttled Cooling Passage Flow For A Window Assembly, And Methods Of Fabrication And Use Thereof".

BACKGROUND AND SUMMARY OF THE INVENTION

The present invention relates to a two-phase fluid flow distribution system and method for a parallel flow evaporator or condenser and, more particularly to a system and method that achieve uniform distribution of the two-phase flow within parallel microchannel heat transfer passages and increase system performance by integrating an orientation-insensitive, two-phase flow distribution device within the inlet manifolds of the microchannel heat exchanger passages.

Traditional evaporators, for instance those in the. refrigeration or air-conditioning industry, utilize a single series flow path or a small number of series flow paths in parallel where an external distributor is used to assure uniform flow within these series flow paths that are flowing in parallel. However, as the flow passages become increasingly smaller, the increased pressure drop associated with a series flow configuration typically requires that all the passages in the evaporator flow in parallel, rather than having some of the flow in series. This is especially true with microchannel evaporators where the passages are typically under 3 mm in hydraulic diameter. Evaporating or condensing refrigerant-to-air heat exchangers (also referred to as coils), as opposed to cold plates, generally consist of a plurality of thin tubes sandwiched by thin folded fins and are connected to and fed fluid by an inlet manifold, with the fluid being discharged to an intermediate manifold or outlet manifold. These manifolds are also commonly referred to as headers. FIGS. 1A and 1B show typical microchannel evaporators of the type discussed below.

The use of an external distributor to feed equal mass flow rate to each passage would he impractical and far too costly for a typical parallel flow microchannel evaporator due to the large number of parallel paths. Therefore, some method is needed to assure that the mass flow rate of the fluid being evaporated is uniformly distributed among all the parallel flow passages that are directly connected to the inlet manifold as shown in FIGS. 1A or 1B. Furthermore, a two-phase flow distribution device that is also not orientation-specific, that is one that does not require gravity to separate the liquid and vapor for proper operation, is needed. The current lack of an effective, manufacturable and reasonably priced, approach has prevented the widespread use of anything but single-bank (also referred to as single-pass) up-flow microchannel evaporators (as shown in FIG. 1A). Furthermore, even when orientation, and therefore the effect of gravity is used to aid in the flow distribution, the resulting distribution is less than ideal.

In a completely parallel-flow condenser, such as a microchannel condenser, the flow distribution is far simpler than for the case of evaporation of a two-phase mixture. This is due to the superheated vapor at the condenser inlet consisting entirely of vapor, and therefore the entire flow in the condenser has consistent physical properties, such as density and viscosity, This superheated floss enters the parallel-flow condenser passages for cooling and subsequent condensation in the, passages (after distribution, into these passages). In a parallel-flow evaporator, however, a two-phase mixture of liquid and vapor, due to the flashing of the refrigerant at the upstream throttling valve, must be equally distributed to each of the passages for optimum performance. As a result, the two-phase mixture distributed to each of the parallel flow passages in an evaporator tend to separate due to differences in the physical properties of the liquid and vapor (liquid and vapor have different physical properties, such as density, wettability and viscosity). The differing properties of the flowing liquid and vapor result in differences in, among other things, the effect of inertial and gravitational forces on the vapor and the denser liquid, resulting in flow maldistribution in a conventional parallel flow evaporator configuration as shown for example in FIG. 1A.

Therefore, while microchannel heat exchangers have largely replaced legacy tube-fin heat exchangers used, for automotive condensers and residential heating, ventilation, air-conditioning, and refrigeration (HVAC-R) condensers due to their increased heat transfer performance, improved form factor, lightweight design and reduced cost, current microchannel evaporators suffer from maldistribution within the manifolds due to the nature of the two-phase fluid flow in the inlet, manifold. This maldistribution causes a decrease in heat transfer performance, thus mitigating the advantages of a microchannel evaporator. For this reason, microchannel evaporators are not typically used in the HVAC-R industry, and tube-fin coils are still the predominant technology for HVAC-R evaporators.

Currently, most HVAC-R systems that use microchannel heat exchangers as an evaporator only do so when a dual-mode air conditioning/heat pump system is being operated as a heat pump. In heating mode, maldistribution of the vapor in the evaporator (outdoor coil) can be tolerated because heating mode performance is generally less critical than cooling mode performance. When this same dual-mode system is operated in the more challenging cooling mode, however, that same outdoor coil is the system condenser and provides improved performance when compared to a conventional tube-fin condenser coil. Therefore, most systems that incorporate a microchannel heat exchanger in HVAC-R, applications utilize the microchannel heat exchanger as the condenser for a single-mode air conditioner, or as the outdoor coil in a dual-mode air conditioner/heat pump. For dual mode HVAC-R systems the outdoor coil operates as the condenser in air conditioner mode and operates as the evaporator when in heating mode.

Another issue with microchannel heat exchangers (and parallel passage heat exchangers in general) used in vapor compression and other two-phase heat transfer systems is that the evaporator or condenser may consist of multiple parallel-path heat exchangers (referred to as "banks" of the overall heat exchanger) where the exhaust header of the first heat exchanger (first bank) is connected. to the inlet header of the next heat exchanger (second bank,) and so on as shown in FIG. 1B for a three bank or three pass heat exchanger. Flow maldistribution is an ongoing problem with banks of heat exchangers operating as evaporators but can also be a problem on the second and subsequent banks of a condenser due to the condensation of some of the working fluid in the first bank becoming maldistributed in the inlet manifold of the second and subsequent banks where a two-phase mixture exiting the first bank of condenser must flow into the inlet manifold (or header) of the next bank of the condenser. in a condenser per se, there is no need to integrate an inlet distributor since the inlet flow is entirely vapor; subsequent banks (subsequent inlet headers) will, however, have a combination of liquid and vapor refrigerant requiring proper flow distribution. The lack of an effective two-phase flow distributor decreases performance of the heat exchanger due to the maldistribution affects incurred.

In the past, two-phase distribution devices, such as either a tube with holes (FIG. 3A) or porous medium (FIG. 3B), have been integrated within the inlet manifold of the microchannel heat exchanger in an effort to increase the uniformity of two-phase flow to the plurality of tubes as shown in FIG. 2A. This type of configuration relies on gravitational forces to separate the liquid and vapor and in the case of a porous medium to keep the liquid from making direct contact with the porous medium and unfavorably saturating the porous medium with liquid. This methodology has not, however, provided uniform two-phase flow in down-flow evaporator configurations or in the down-flow portions of multi-bank evaporators or condensers such as shown in FIG. 1B. The absence of an effective distributor mechanism both at the inlet and also between sequential banks within the heat exchanger results in a maldistributed flow and degrades both the heat exchanger and system performance. In the past, this has led to complicated and expensive attempts to avoid multiple bank heat exchangers or to configure up-flow-only evaporators or some other manifold configuration where gravity is used to keep the liquid away from the porous medium. If liquid contacts the porous medium, then capillary action draws the liquid into the pores, starving the downstream portions of the manifold from achieving proper liquid distribution by preventing the liquid from traversing the full length of the inlet manifold. For instance, manufacturing methods have been developed that bend the plurality of tubes to retain a single-bank heat exchanger rather than directly address the issue of flow maldistribution. That approach does not provide a solution for the underlying problem and fails to allow for the creation of compact multiple bank heat exchanger configurations such as shown in FIG. 2B, instead forcing the use of larger, more expensive to manufacture, and more cumbersome multi-bank evaporators of the type shown in FIGS. 4A and 4B, where all evaporation occurs in up-flow and with gravity assisting in the performance of the flow distribution device.

The need for up-flow only evaporator configurations for proper operation of the flow distributing device, that is the need for using gravity to separate the liquid and vapor and prevent liquid from saturating the porous medium, means that the compact multi-bank heat exchangers where up-flow and down-flow patterns are used in alternating tube banks, would have flow distribution issue in the down-flow banks. For example, the simplest, most compact and cost-effective way to create a multi-bank microchannel evaporator is to pass refrigerant from one bank to the next as shown in FIG. 1B. This method simply allows the flow to progress further down. the intermediate portion of manifold 102' as shown by the flow arrow 121', where the refrigerant upward flow in Bank 1 is denoted by flow arrow 120' (and upward flow stops at. barrier 108') and then the flow progresses down manifold 102' flowing downward in Bank 2, as shown by flow direction arrow 122' (down-flow stops at barrier 118'). Flow then progresses through the intermediate portion of the lower manifold 103' as shown by the flow arrow 123', where the refrigerant upward flow in Bank 3 is denoted by flow arrow 124' (and up-flow stops at end cap 115') and then the flow exits at 106'. Up until now, there have been no effective flow distribution methods for the downward flow section(s) of such a heat exchanger and therefore other costlier approaches have had to been employed. For example, to assure all parallel passages are in an up-flow orientation, a jumper tube is used (as shown, for example, in FIGS. 4A and B as 488 and 489) so that all flows are up-flows and therefore gravity can be used to enable the two-phase flow distribution device to properly feed the parallel passages, since good flow distribution is always necessary in the inlet manifold to the parallel-flow microchannel passages.

The present invention addresses these problems with a novel system and method of improving two-phase distribution in microchannel evaporators with single or multiple banks without creating significant pressure drop and without the need to only operate in a specific orientation. We have improved the two-phase flow of the evaporator by incorporating a porous medium along with an impervious passage (or surface coating on the porous medium) as part of the evaporator manifolds for both single and multi-bank arrangements. We have found that our invention uniformly distributes the liquid phase throughout the header and mitigates gravitational and inertial separation effects in the inlet or intermediate manifolds. Within the microchannel evaporator, the device can be integrated into the manifolds, between passes, between banks or any combination thereof.

We have performed experiments to verify that the use of a combination of a porous medium which incorporates a non-permeable surface with discreet openings to allow the liquid to evenly migrate into the porous surface provides an improved flow distributor in both up-flow and down-flow configurations as will be described in greater detail below. In these thermal images, the dark areas represent the presence of liquid or two-phase flow, and thus areas where good flow distribution has been achieved is shown when these areas are present across the length of the evaporator.

In our invention, a conventional thermostatic expansion valve (TXV) or other type of metering device is provided upstream of the evaporator to effectively reduce the pressure of the fluid so as to create the two-phase conditions. While, in general, this configuration can be used with any parallel passage heat exchanger configuration employing an inlet header, our invention will also accommodate microchannel evaporators or condensers formed by using flat tube parallel passages separated by folded fins.

In our invention, a single manifold can contain multiple distribution arrays to promote uniform distribution between banks (also referred to "passes") of the evaporator. These novel distribution arrays can be separated by a flow obstruction and allow for alternating upward and downward flow of the fluid. The banks of the microchannel evaporator can contain an identical or varying number of tubes.

Additionally, multiple bank evaporators can be connected by using a single manifold incorporating our unique unibody approach that directly takes fluid from one bank to the next without the use of a jumper tube. These manifolds use the distribution method of our invention to reduce maldistribution and can be manufactured from multiple parts brazed together or as a single tube extrusion.

BRIEF DESCRIPTION OF THE DRAWINGS

These and other objects, features and advantages of the present invention will become more readily apparent from the following detailed description thereof when taken in conjunction with the accompanying drawings wherein:

FIG. 2A is an isometric view of a of a known single-bank parallel path microchannel heat exchanger such as an up-flow evaporator with an internal tube-in-tube flow distributor located in the inlet manifold at the bottom of the heat exchanger.

FIG. 2B is a cross-sectional front view of a multi-bank microchannel evaporator in accordance with the present invention with inlet and intermediate inlet flow distributors located within the top and bottom manifolds

FIGS. 4A and 4B are, respectively, front- and a cross-sectional-rear views of a three-bank microchannel up-flow evaporator with a traditional orientation-dependent, gravity-separating flow distributors located at the bottom of the evaporator banks and within the inlet manifold sections of the three banks and with a known type of jumper tubes that connect sequential passes, such that all parallel flow passages are up-flow.

FIG. 6 is a cross-sectional front view of a three-bank microchannel condenser of our present invention, with the flow distribution mechanism located only in the inlet to the second and third banks of the condenser.

FIG. 7A shows an infrared thermal image displaying the performance of a tube-in-a-tube configuration of the type shown in FIG. 3A; FIG. 7B shows an infrared thermal image displaying the performance of a porous medium with a central open-cavity flow distributor of the type shown in FIG. 3B; and FIG. 7C shows an infrared thermal image displaying the performance the thermal performance of a plate with an array of holes combined with porous medium of the type shown in FIG. 3D according to the present invention).

DETAILED DESCRIPTION OF THE DRAWINGS

Figure 1A:
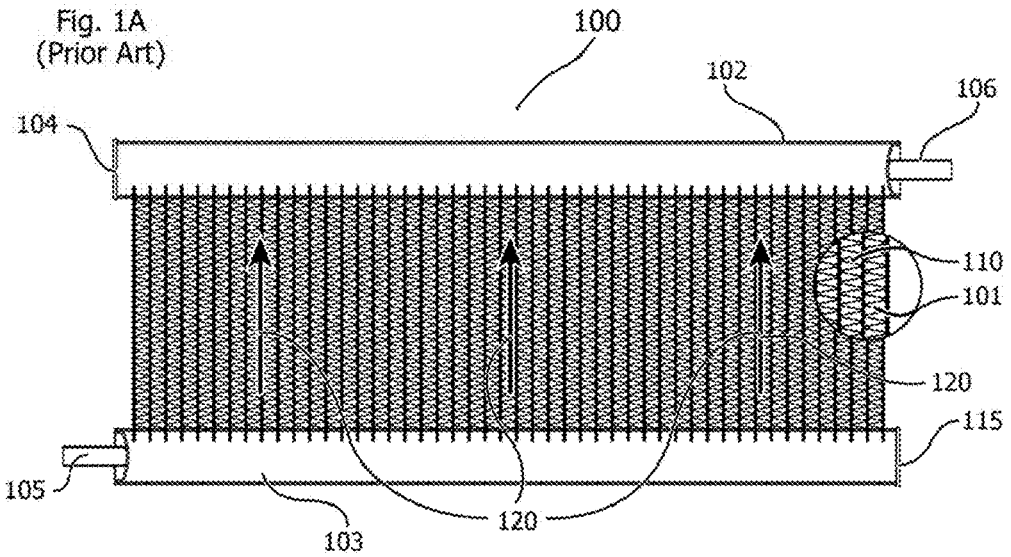
Fig. 1A (Prior Art)
FIG. 1A is an isometric, isolated view of a known single-bank parallel path conventional microchannel heat exchanger such as an evaporator or condenser.

FIG. 1A shows one known construction of a single-bank microchannel evaporator designated generally by numeral 100, where two-phase refrigerant enters the evaporator, via an inlet 105 into an inlet manifold 103. Refrigerant then flows through a plurality of parallel-flow heat transfer passages 110 that are positioned between an outlet manifold 102 and the inlet manifold 103 as shown by the flow direction arrows 120. Finned surfaces 101 (as seen in the enlarged isolated section in the circle at the right can be optionally placed between the passages 110 to improve air-side heat transfer to the heat, transfer passages 100. Sealing end caps 104, 115 are placed at the ends of the inlet manifold 103 and outlet manifold 102. An outlet tube 106 is attached to the outlet manifold. The internal passageways of the inlet and outlet manifolds 103, 102 allow the refrigerant access to flow into and out of the parallel-flow passages 110, but the manifolds have no way to assure uniform flow distribution within the parallel-flow passages 110.

Figure 1B:
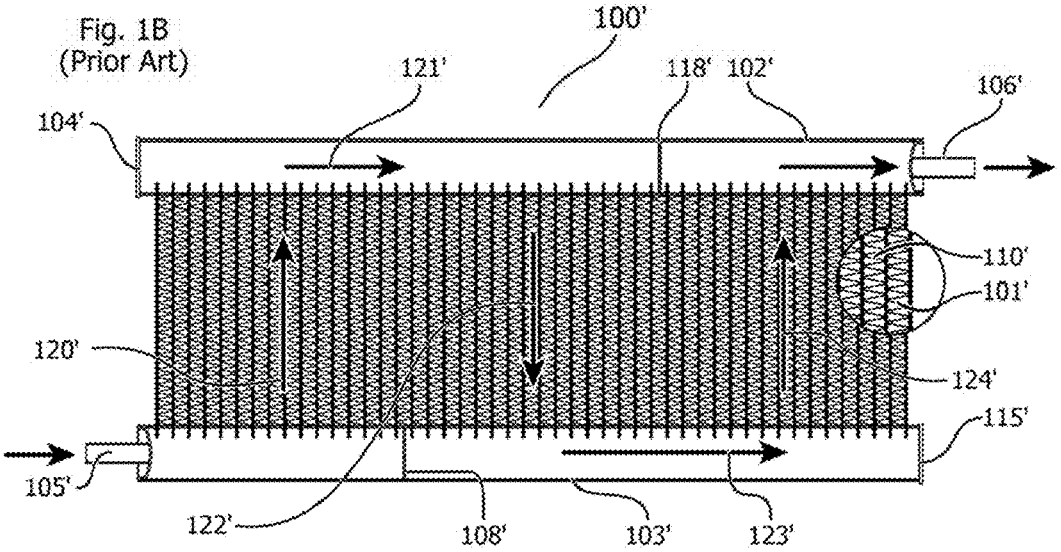
Fig. 1B (Prior Art)
FIG. 1B is a cross-sectional front view of a known three-bank microchannel heat exchanger such as an evaporator or condenser.

FIG. 1B shows a known construction of a three-bank microchannel evaporator 100', where two-phase refrigerant enters the evaporator, via an inlet 105' into a portion of manifold 103'. Refrigerant then flows upward through the plurality of parallel-flow heat transfer passages 110' that are positioned between the inlet 105' and a flow obstruction 108' as shown by the flow direction arrow 120' exiting the parallel-flow passages and entering the manifold 102'. Refrigerant, then flows through an intermediate portion of the manifold 102' to enter the plurality of parallel-flow down-flow heat transfer passages 110' that are positioned upstream of the flow obstruction 118' as shown by flow direction arrows 121'. Another flow direction arrow 122' shows the direction of the refrigerant down-flow in the parallel-flow passages and entering the intermediate portion of manifold 103'. Refrigerant then flows through the intermediate portion of manifold 103' in the direction shown by flow direction arrow 123' to enter the plurality of parallel-flow heat transfer passages 110' that are positioned upstream of end cap 115' (flow direction arrow 124'). After the up-flow of refrigerant exits the last bank of parallel-flow passages 110' it enters the end section of manifold 102' and exits the heat exchanger at an outlet 106'. Here too, finned surfaces 101' can optionally be placed between the passages to improve air-side heat transfer to the heat transfer passages 110' (as seen in the enlarged isolated section in the circle at the right). The internal passages ways of the inlet and outlet manifolds 103', 105', respectively, allow the refrigerant access to flow into and out of the parallel passages 110', but again these manifolds do not assure uniform flow distribution, making this an ineffective evaporator for all practical purposes.

Figure 3A:
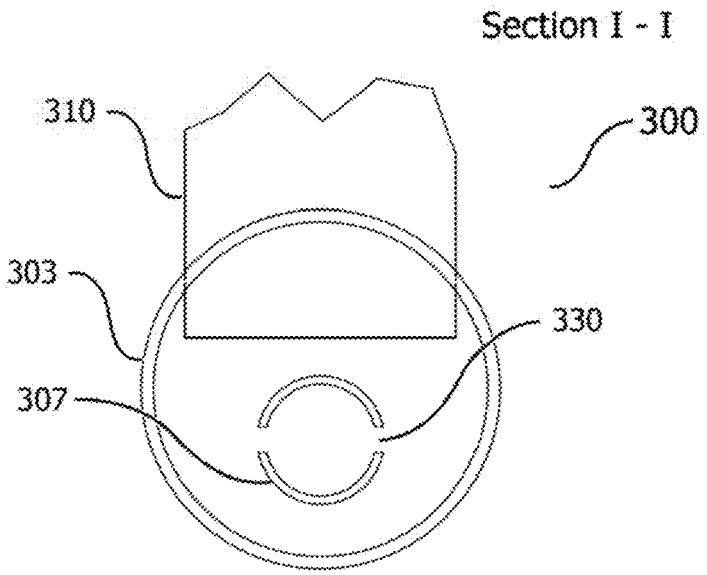
Fig. 3A (Prior Art)
FIGS. 3A through 3D depict, respectively, cross-sectional views of a known tube-in-tube arrangement and such an arrangement using a known type of a porous medium taken along line I-I of FIG, 2A, and two novel tube-in-tube arrangement configurations taken along line II-II of FIG. 2B incorporating an impervious layer with discrete radial pathways that assure a uniform supply of two-phase flow to an array of parallel passages regardless of orientation.
Figure 3B:
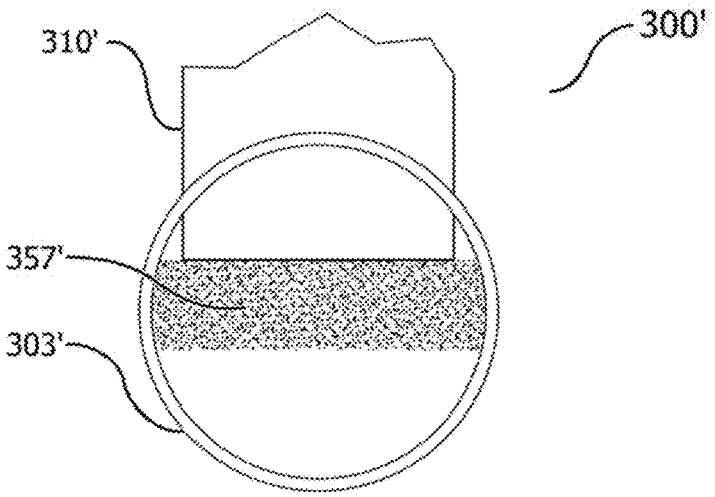
Fig. 3B (Prior Art)

FIG. 2A shows one known embodiment, for a single-pass/single-bank, microchannel evaporator designated generally by numeral 200 incorporating either an orientation-dependent tube-in-tube (as shown) or porous medium flow distribution device such as FIGS. 3A or 3B. The microchannel evaporator 200 contains a plurality of parallel-flow passages 210 that are positioned between an inlet manifold 203 and an outlet manifold 202. End caps 204, 215 are placed at the ends of manifolds 202, 203, respectively. An inlet tube 205 is attached to the inlet manifold 203, and an outlet tube 206 is attached to the outlet manifold 202. A known two-phase fluid distributor 207 of the types shown in FIG. 3A or FIG. 3B and described herein below is located within the lower inlet manifold 203 and along the entrance of each of the microchannel parallel-flow passages 210 to promote uniform up-flow across the plurality of parallel-flow tubes. Flow direction arrows 220 show the direction of the refrigerant flow before exiting the parallel-flow passages 210 and entering the outlet manifold 202, As described above, finned surfaces 201 can optionally be placed between the passages to improve air-side heat transfer to the heat transfer passages 210.

FIG. 2B shows a currently contemplated embodiment of a multi-bank, in this case three-bank (also referred to as a "three-pass") evaporator designated generally by numeral 200'. This configuration had not been practical without the development of an orientation-independent flow distributor to make down-flow evaporation uniform and effective. In this configuration, two-phase refrigerant enters the evaporator, via an inlet 205', flowing into an inlet flow distribution device 207' located inside a portion of a manifold 203'. Refrigerant is evenly distributed by the flow distribution device 207' and then flows through the plurality of parallel-flow heat transfer passages 210' that are positioned between the inlet 205' and a flow obstruction 208' as shown by a flow direction arrow 220' exiting the parallel-flow passages 210' and entering a manifold 202'. Refrigerant then flows through the manifold 202' and is forced by a flow diverter 209' to enter a flow distribution device 217' positioned between the flow diverter 209' and the flow obstruction 218' as shown by a flow direction arrow 221'.

For the configuration of FIG. 2B to operate successfully, however, the down-flow flow distributor device 217' needs to evenly distribute the two-phase flow downward into the parallel-flow passages 210' that are positioned between the flow diverter 209' and the flow obstruction 218' as shown by a flow direction arrow 222' exiting the parallel-flow passages 210' and entering the center section of the manifold 203'. Refrigerant then flows through the manifold 203' in the direction shown by a flow direction arrow 223' and forced by the flow diverter 219' to enter the flow distribution device 227' positioned between the flow diverter 219' and the end cap 215'. Refrigerant is, evenly distributed by a flow distribution device 227' and then flows upward through the plurality of parallel-flow heat transfer passages 210' that are positioned between the flow diverter 219' and the end cap 215' as shown by flow direction arrow 224' exiting the parallel-flow passages 210' and entering the end-section of the manifold 202'. Refrigerant then flows through the end-section of the manifold 202' to exit the heat exchanger at an outlet 206', Again, finned surfaces 201' can optionally be placed between the passages to improve air-side heat transfer to the heat transfer passages 210'. While FIG. 2B shows a three-bank configuration, it is to be understood that this pattern can be used to create two or more banks (passes) of parallel-flow passages. Our approach effectively separates the manifolds and creates an effective alternating upwards and downwards flow pattern to the extent an orientation-insensitive fluid flow distributor is available.

The microchannel evaporator of our invention operates in up-flow, down-flow and horizontal flow to allow the compact, low-cost manufacture of multi-bank alternating up-flow and down-flow microchannel evaporators, down-flow evaporators and multi-bank alternating up-flow and down-flow condensers. FIG. 3A depicts a cross-sectional view of the tube distributor of a known configuration where the respective flow distribution devices in the form of a tube 307 defining a fluid passageway with multiple flow distribution outlets 330 to distribute the two-phase mixture throughout the manifold and thereby feed the parallel flow passages. As was discussed with respect to FIGS. 2A and 2B, any flow distribution devices 207, 207' would be located inside the manifold 203. 203', respectively. This known flow-distributor tube 307 shown in FIG. 3A could be located inside the inlet manifold to create a known "tube-in-tube" type flow distributor. When oriented for up-flow, i.e., the parallel passages are above the flow-distributor, this distribution device uses gravity to separate the liquid so that the separated liquid flows along the bottom of the manifold and can do a reasonable job of directing the fluid down the axis of the flow distributor with minimal pressure drop, while fluid that exists the distributor incurs moderate pressure drop through either hole arrays, slots, microgrooves, or a combination thereof 330.

FIG. 3B show yet another known embodiment of an orientation-dependent flow distribution device that can be located inside the inlet manifold or inside any intermediate manifold sections in a multi-bank phase changing (evaporating or condensing) heat exchanger, In this embodiment, the flow distribution device is a porous medium 357'. The porous medium 357' along with the walls of the manifold create a lower flow chamber where two-phase refrigerant can flow with the majority of the liquid migrating to the base of the manifold (due to gravity) and not primarily in contact with the porous medium. The liquid refrigerant is not saturating the porous medium and is not being drawn into the porous medium by capillary action, Unfortunately, this known flow distribution device is ineffective if inverted, that is if the parallel-flow passages exit the lower portion of the assembly and the porous medium along with the walls of the manifold, create an upper flow chamber where two-phase refrigerant can flow with the liquid migrating to the base or bottom of the flow chamber and therefore now in direct contact. with the porous medium. This configuration is ineffective because capillary action fills the porous medium and causes the liquid refrigerant to saturate the surface removing the majority of the, liquid from, the distribution path before the refrigerant can be uniformly distributed down the length of the flow distributor.

Figure 3C:
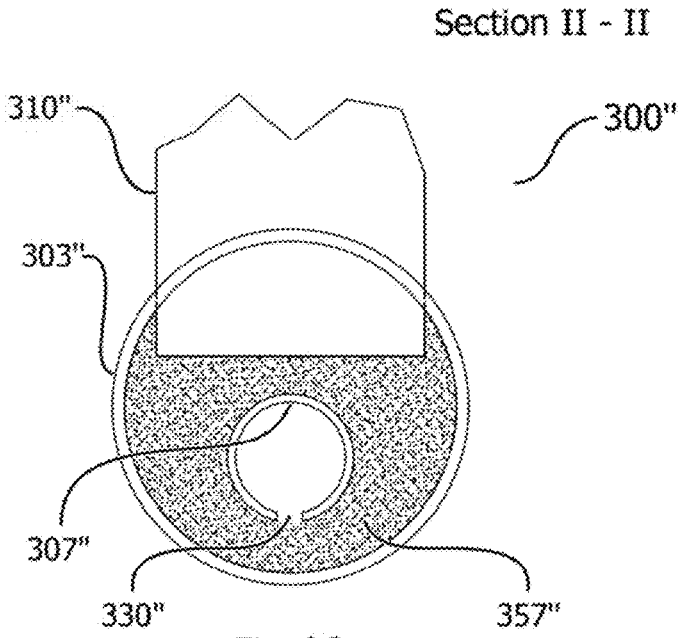

However, we have discovered that if the porous medium is covered with a non-porous surface to prevent the migration of the liquid refrigerant into the pores of the media, then an orientation independent flow distributor can be created. FIG. 3C shows one such embodiment where the porous medium surrounds an internal passageway created by a flow distribution tube 307" inserted into the porous medium 357" to create a low-axial-pressure drop center flow passage, Although a tube or impervious walled structure is specifically shown in FIG. 3C, one skilled in the art would now, with the benefit of our disclosure, understand that instead of a wall or surface inserted into the porous material as shown, a non-permeable coating on the surface of the porous medium can be used in the same way to create a non-permeable flow passage in the axial flow direction with periodic or regular openings of the type shown in the tube of the FIG. 3C distributor. Furthermore, instead of the circular tube-type passage shown in FIG. 3C, a passageway of any cross-sectional shape with periodic or regularly arranged openings (along the axis of flow) to allow the refrigerant to travel into the porous medium is also sufficient to prevent undesired. migration. For example, the tubular passage 307" could be rectangular, square, triangular or any other desired shape and could have slots, holes or other openings 330" located in the region of the parallel-flow passages 310" to allow the working fluid to enter a porous bed 357" from the flow distribution tube 307". These openings 330" can be located at any angle relative the parallel-flow passages. For example, in FIG. 3C the openings 330" are located approximately 180 degrees from the parallel flow passages 310" whereas they can be, for example, located at 0, 90, and or 270 degrees. The porous medium may completely fill the header volume between the internal passageway and the flow distribution tube, or only be present in a portion of this volume. Our invention can employ other types of known porous media such as rolled or woven screen, open cell foam, porous ceramic material, packed beads, packed cellulous material, packed irregularly-shaped particles, packed regularly-shaped particles, compressed wire segments, packed sand, porous sponge and the like.

Figure 3D:
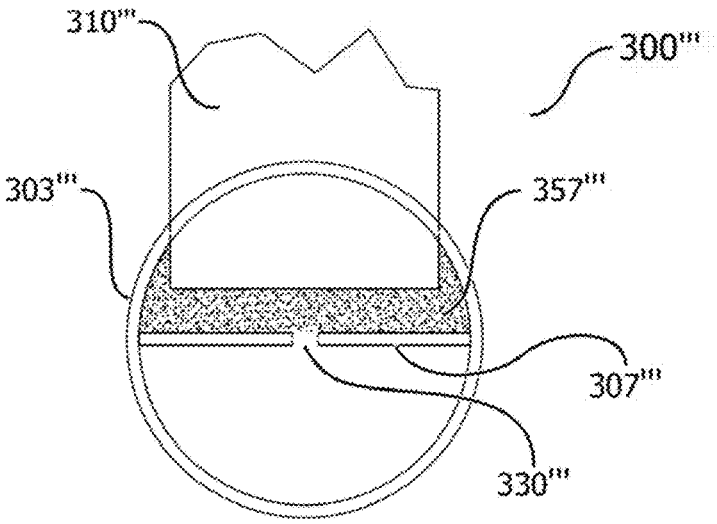

FIG. 3D shows yet another embodiment of our flow distribution invention where, instead of inserting an impermeable passageway with periodic openings as shown in FIG. 3C, the manifold is segmented into two separate flow passages by either coating the surface of the porous medium with a non-permeable coating or using a wall 307''' to separate the porous medium 357''' from the axial flow passage to provide a nearly impervious flow distribution passageway with multiple flow distribution outlets 330''' to distribute the two-phase mixture to parallel flow passages 310'''. Both the FIGS. 3C and 3D configurations provide a pressure drop in the axial flow direction that is low that the pressure drop in the radial direction (that is, in the direction through the openings in the non-permeable material and through the porous material). This flow-distributor divided passageway can also utilize an assortment of hole arrays, slots and microgrooves (all denoted as 330''' FIG. 3D.) depending upon the intended use. In this embodiment, two-phase fluid flows through the inlet and into the first distribution passageway created by the flow distribution wall 307''' and a portion of the manifold 303''' for a first pass of the microchannel evaporator. The distribution device, like FIG. 3C or 3D, also directs fluid along the axis of the distributor with minimal pressure drop while fluid that exists the distributor incurs moderate pressure drop through hole arrays, slots, microgrooves, or a combination 330'''. Once again, this is one embodiment of an effective flow distribution device that can be located in any orientation inside the inlet manifold or inside any intermediate manifold sections in a multi-bank phase-changing (evaporating or condensing) heat exchanger. It is also to be understood that different flow distribution devices can be used in different inlet banks of a multi-bank heat exchanger within the skill of those in the art in light of our disclosure.

FIGS. 4A and 4B show front and partially sectioned rear views of a three-bank microchannel evaporator designated generally by numeral 400 employing a well-known gravity dependent up-flow configuration. Like the other microchannel evaporators of FIGS. 2A and 2B, the microchannel evaporator 400 has a plurality of parallel-flow passages 410 positioned between manifolds 402, 403. Solid internal walls 408 partition the manifold 402 into separate chambers 402A, 402B, 402C, Likewise, solid internal walls 408 partition the manifold 403 into separate chambers 403A, 403B, 403C. This multi-bank heat exchanger has been configured for up-flow evaporation only in which two-phase refrigerant enters the evaporator, via the inlet 405, flowing into a traditional gravity-dependent inlet flow distribution device 407 located inside chamber 403A. Refrigerant is somewhat evenly distributed by the flow distribution device 407 and then flows upward through the plurality of parallel-flow heat transfer passages 410 that are positioned to face the flow distribution device 407 and between an inlet 405 and a flow obstruction 408 as shown by a flow direction arrow 420 exiting the parallel-flow passages and entering the manifold chamber 402A. Refrigerant then exits manifold chamber 402A and flows down jumper-tube passage 488 in the direction shown by flow direction arrow 421 and enters manifold chamber 4038 where it then flows into a gravity-dependent flow distribution device similar to 407 inside manifold chamber 403B. Refrigerant then exits the gravity-dependent flow distribution device and enters the parallel flow passages 410 located in manifold chamber 403B. Refrigerant flows upward through the plurality of parallel-flow heat transfer passages 410 and upon exiting the parallel-flow passages, enters the center manifold chamber 402B. Refrigerant then exits manifold chamber 402B and flows down jumper-tube passage 489 in the direction shown by flow direction arrow 423 and enters manifold chamber 403C where it then flows into a gravity-dependent flow distribution device similar to 407 inside the manifold chamber 403C. Refrigerant exits the gravity-dependent flow distribution device and enters parallel flow passages 410 located in manifold chamber 403C. Refrigerant flows upward through the plurality of parallel-flow heat transfer passages in the direction shown by flow direction arrow 424 and exits the parallel-flow passages into the end of manifold chamber 402C before exiting the heat exchanger via an outlet 406. Although FIGS. 4A and 4B show a three-bank configuration, it is to be understood that a similar configuration and flow method can be used for only two banks or more than three banks of parallel-flow passages. This known approach effectively separates the manifolds but due to the limitations of flow distributors known in the art, must maintain an upward flow pattern in all heat exchanger banks for best performance.

Figure 5A:
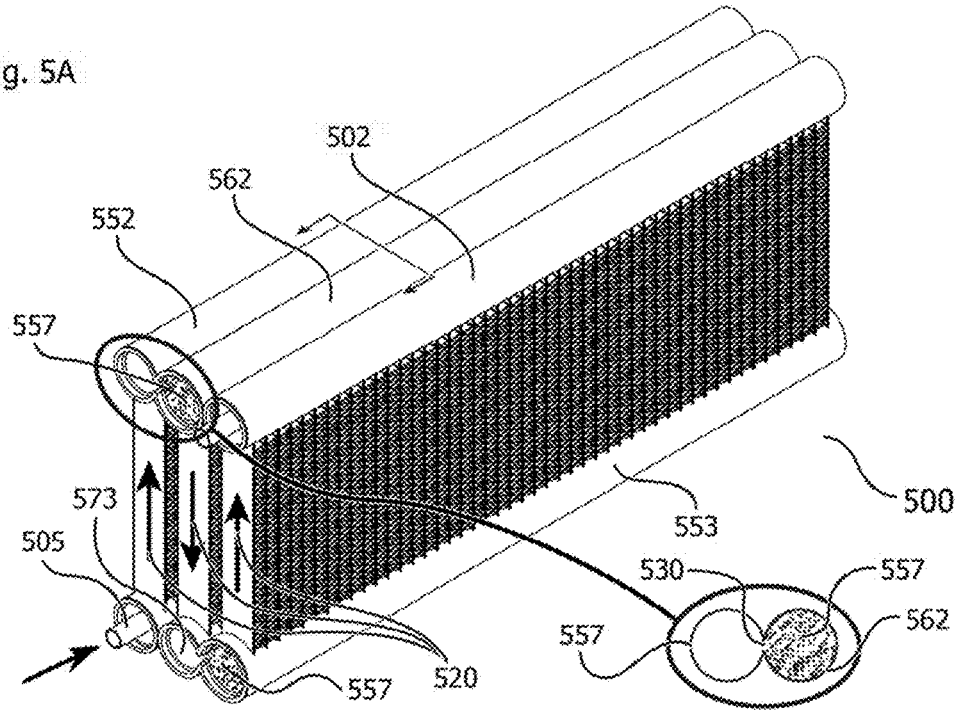
FIGS. 5A and 5B are isometric views of two different embodiments of multi-bank microchannel evaporators where the inlet and outlet manifolds have been combined or joined and the gravity insensitive flow distribution method of our invention can be used for uniform flow distribution even in the down-flow configuration of the second bank.

FIG. 5A shows yet another embodiment. of our orientation-insensitive improved flow distribution device incorporated into a multi-bank microchannel evaporator generally designated by numeral 500 where an outlet manifold of a first bank 552 is physically connected with a flow distribution device of the type shown in FIGS. 3C and 3D to allow refrigerant to flow downward via parallel flow passages. Likewise, an outlet manifold 573 of the second bank 562 is physically connected and flows directly into the adjacent inlet manifold of a third bank 502. A flow-distributing media 557 of the type shown in FIGS. 3C and 3D is also provided inside the inlet manifold of the third bank 502. Finally, the refrigerant entering an outlet manifold of the third bank 502 exits the heat exchanger via an outlet 506. Flow directions in the three banks are shown by flow directions arrows 520, 521, 522 showing that alternating upward and downward flow is created between each bank of the microchannel evaporator 500.

Figure 5B:
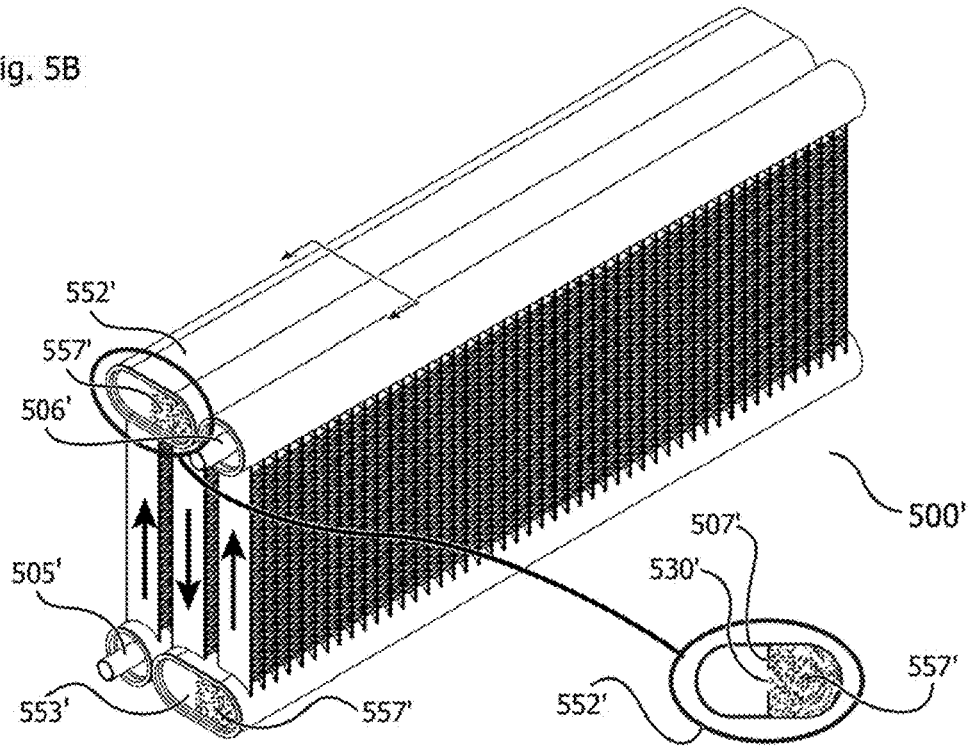

FIG. 5B shows still another embodiment of our multi-bank microchannel evaporator generally designated by numeral 500' similar to that of FIG. 5A, except that instead of having an outlet manifold 552 of the type shown in FIG. 5A connected to the inlet manifold 562, the manifolds of two banks have been combined into a single manifold 552' in FIG. 5B. In manifold 552', the porous medium inlet flow distribution device 557' of the type shown in FIGS. 3C and 3D located in the inlet manifold of FIG. 5A, is now located in a section of manifold 552' that is directly above inlets to parallel-flow passages of a second bank and is coated with a no protective film or flow barrier wall to prevent refrigerant from completely wetting the surface of the porous medium. Likewise, instead of having an outlet manifold 573 of the type shown in FIG. 5A connected to the inlet manifold 553 of the subsequent bank, these manifolds have been combined into a single manifold 553' in FIG. 5B. In manifold 553', once again the flow distribution device 557' of the type shown in FIGS. 3C and 3D that is located in the inlet manifold of FIG. 5A, is now located in the section of manifold 553' that is directly above inlets to the parallel-flow passages of a third bank and once again is coated with a protective film or flow barrier wall of the present invention to prevent refrigerant from completely wetting the surface of the porous medium.

FIG. 6 represents another currently contemplated embodiment of our invention for a three-bank or three-pass condenser designated generally by numeral 600, In this embodiment, superheated or saturated refrigerant, vapor enters the condenser 600, via an inlet 605, (no inlet flow distribution device being necessary because all the refrigerant is a vapor that distributes equally to all of the passages 610). Refrigerant flows up in an evenly distributed manner through the plurality of parallel-flow heat transfer passages 610 that are positioned between the inlet 605 and a flow obstruction 608 as shown by a flow direction arrow 620 exiting the parallel-flow passages 610 and entering a manifold 602 as a partially-condensed liquid and vapor mixture. Refrigerant then flows through the manifold 602 and is forced by a flow diverter 609 to enter a flow distribution device 617 of the type shown in FIGS. 3C and 3D positioned between the flow diverter 609 and the flow obstruction 618 as shown by a flow direction arrow 621. Refrigerant is evenly distributed by the flow distribution device of the types shown in FIGS. 3C and 3D 617 and then flows down through the plurality of parallel-flow heat. transfer passages 610 that are positioned between the flow diverter 609 and the flow obstruction 618 as shown by a flow direction arrow 622 exiting the parallel-flow passages 610 and entering the center section of the manifold 603 as a further condensed liquid and vapor mixture. The refrigerant liquid-vapor mixture then flows through the manifold 603 in the direction shown by a flow direction arrow 623 and is forced by the flow diverter 619 to enter the flow distribution device 627 of the types shown in FIGS. 3C and 3D positioned between the flow diverter 619 and the end cap 615. Refrigerant is evenly distributed by the flow distribution device 627 of the type shown in FIG. 3C and 3D and then flows through the plurality of parallel-flow heat transfer passages 610 that are positioned between the flow diverter 619 and the end cap 615 as shown by flow direction arrow 624 exiting the parallel-flow passages 610 and entering the end-section of the manifold 602. Refrigerant then flows through the end-section of the manifold 602 to exit the condenser at an outlet 606. Again, finned surfaces 601 can optionally be placed between the passages to improve air-side heat transfer to the heat transfer passages 610. While FIG. 6 shows a three-bank condenser configuration, it is to be understood that this pattern can be used to create two or more banks or passes of parallel-flow passages.

Figure 7A:
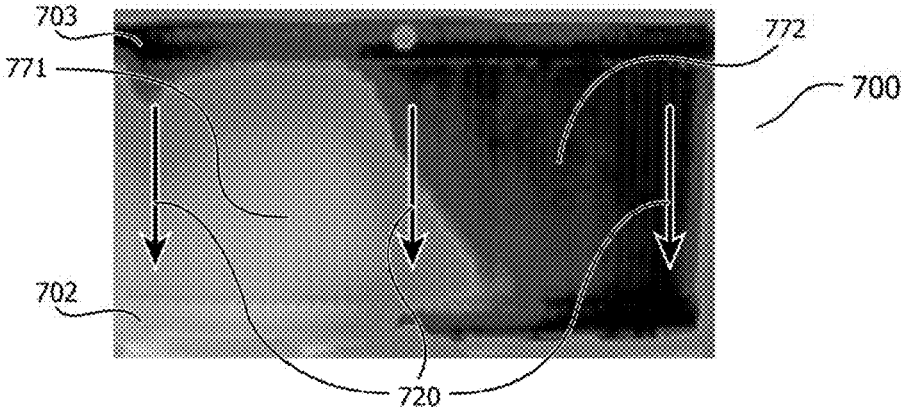
FIGS. 7A-C show infrared thermal images of the same inlet manifold of a microchannel evaporator fitted with the FIGS. 3A, 3B and 3C flow distribution configurations (respectively). More specifically.
Figure 7B:
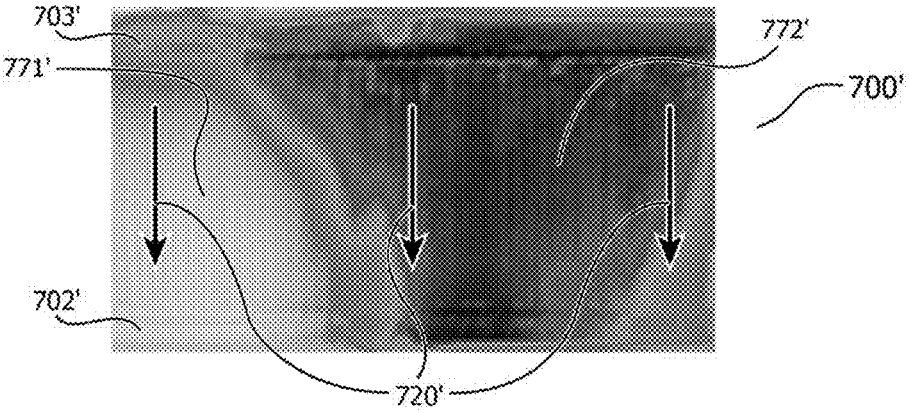
Figure 7C:
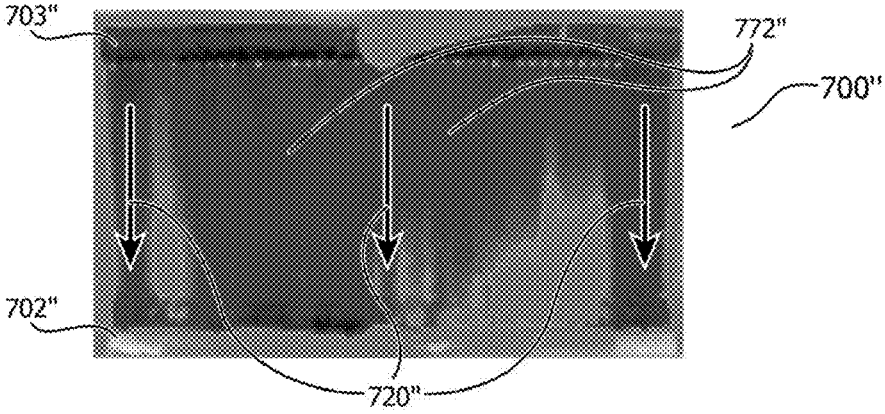

Using the same experimental set-up and evaporator (with the only difference among single-pass evaporators being the type of flow distributor used) three heat exchanger distributors were tested with down-flow. FIGS. 7A-C are infrared images that compare the experimental performance of single-pass evaporators with three distributor options, two options being known and the third option using the present invention. FIG. 7A is a microchannel evaporator 700 where fluid enters the inlet manifold 703, which contains a tube-in-tube type distributor of the type shown in FIG. 3A, and then passes in downward flow 720 to the outlet manifold 702. The dark areas 772 on the heat exchanger surface indicate the presence of liquid or two-phase flow, while the light areas 771 indicate that only superheated vapor flow is present. The microchannel evaporator 700 has poor liquid distribution, as indicated by the limited extent of areas with liquid 772 across the evaporator area. FIG. 7B is the same microchannel evaporator 700' with a porous medium distributor in the inlet manifold 703'. The porous medium distributor (FIG. 3B type of configuration) is full of porous medium except a central open axial cavity running the length of the distributor. The fluid passes in downward flow 720' and then exits through the outlet manifold 702'. Again, the dark areas 772' representing the presence of liquid or two-phase flow do not cover a significant portion of the evaporator area, indicating that the heat exchanger has poor flow distribution. The remaining light areas 771' only contain superheated vapor. FIG. 7C is the same microchannel evaporator 700" with one embodiment of the present invention (shown in FIG. 3D) in the inlet manifold 703". Fluid enters through this manifold and then passes in downward flow 720" before exiting through the outlet manifold 702". This configuration significantly improves liquid distribution, and the dark areas 772" where liquid or two-phase flow are present cover the majority of the heat exchanger surface area. No light areas indicating the presence of superheated vapor are observed.

In summary, FIG. 7A demonstrates that the tube distributor provides poor distribution and results in a system Coefficient of Performance (COP) of 1.81, while FIG. 7B demonstrates that the porous medium, distributor also provides poor distribution and results in a system COP of 1.93. However, FIG. 7C demonstrates that the thermal performance of an embodiment of the present invention (FIG. 3D) exhibits far better flow distribution (i.e., more uniform dark color distribution in FIG. 7C) that resulted in a system COP of 2.14 Again, the above COP data was measured on the same experimental system where only the evaporator phase distribution method was altered. In addition, both the FIGS. 3A and 3B flow distribution configurations experienced heat exchanger frosting, a further indication of poor flow distribution and decreased system COP, but our invention with improved distribution avoided undesirable evaporator-frosting.

While we have shown and described several embodiments of our invention, we wish to make clear that the same is subject to changes and modifications that would not depart from the principles of our invention. Therefore, we intend to cover all such changes and modifications as are encompassed by the scope of the appended claims.

We claim:

1. A heat exchanger with a working fluid, comprising parallel-flow passages, configured to flow the working fluid in one of a single direction within the passages and in alternating directions within the passages, at least one inlet manifold operatively connected to the passages for supplying the working fluid thereto, and a flow distributor arrangement arranged within the inlet manifold and configured to provide a uniform distribution of the working fluid to the passages, wherein the flow distribution arrangement comprises a porous medium located inside the inlet manifold and a non-permeable material located between the working fluid and the porous medium, the non-permeable material being configured to allow the working fluid to enter the porous medium through one or more openings in the non-permeable material along a length of the at least one flow passage and arranged to provide a pressure drop along a length of the at least one flow passage that is lower than that of a pressure drop in a radial direction of the inlet manifold.

2. The heat exchanger of claim 1, wherein the non-permeable material comprises a surface of the porous medium..

3. The heat exchanger of claim 1, wherein the porous medium is comprised of at least one of rolled screen, open cell foam, porous ceramic, packed particles, round beads, compressed wire, open-cell sponge and assorted particles.

4. The heat exchanger of claim 1, wherein the non-permeable material is a coating on the porous medium.

5. The heat exchanger of claim 1, wherein the non-permeable material is selected and arranged to prevent uneven saturation of the surface of the porous medium.

6. The heat exchanger of claim 1, wherein the porous medium is arranged to surround passage fins extending into the inlet manifold.

7. The heat, exchanger of claim 1, wherein the non-permeable material is comprised of a wall adjacent to the porous medium and configured to divide the at least one inlet manifold into separate passageways, with one passageway filled with the porous medium and another passageway, where the working fluid will be flowing axially along the at least one inlet manifold.

8. The heat exchanger of claim 1, further comprising a multiple manifold dividing the passages into chambers such that the working fluid flows in only one direction through the passages.

9. The heat exchanger of claim 8, wherein the non-permeable material comprises a surface of the porous medium.

10. The heat exchanger of claim 9, wherein the porous medium is comprised of at least one of rolled screen, open cell foam, porous ceramic, packed particles, round beads, compressed wire. open-cell sponge and assorted particles.

11. The heat exchanger of claim 9, wherein the non-permeable material is a coating on the porous medium.

12. The heat exchanger of claim 9. wherein the non-permeable material is selected and arranged to prevent uneven saturation of the surface of the porous medium.

13. The heat exchanger of claim 1, further comprising a first outlet manifold associated with a first bank of the passages being operatively connected with an adjacent inlet manifold of the at least one manifold associated with a second bank of the passages, and a second outlet manifold associated with a second bank of the passages being operatively connected with an adjacent inlet manifold of the at least one manifold. associated with a third bank of the passages.

14. The heat exchanger of claim 1, further comprising a first outlet manifold associated with a first bank of the passages being configured to function as an adjacent inlet manifold of the at least one manifold associated with a second hank of the passages, and a second outlet manifold associated with a second bank of the passages is configured to function as an adjacent inlet manifold of the at least one manifold associated with a third bank of the passages.

* * * * *